US011641698B2

(12) United States Patent
Kobler et al.

(10) Patent No.: US 11,641,698 B2
(45) **Date of Patent: *May 2, 2023**

(54) CONNECTING THERMALLY-SPRAYED LAYER STRUCTURES OF HEATING DEVICES

(71) Applicant: BSH Hausgeräte GmbH, Munich (DE)

(72) Inventors: Stefan Kobler, Tacherting (DE); Robert Kühn, Traunreut (DE); Philipp Schaller, Traunreut (DE)

(73) Assignee: BSH Hausgeräte GmbH, Munich (DE)

( * ) Notice: Subject to any disclaimer, the term of this patent is extended or adjusted under 35 U.S.C. 154(b) by 363 days.

This patent is subject to a terminal disclaimer.

(21) Appl. No.: 15/747,171

(22) PCT Filed: Jul. 1, 2016

(86) PCT No.: PCT/EP2016/065541

§ 371 (c)(1),
(2) Date: Jan. 24, 2018

(87) PCT Pub. No.: WO2017/021076

PCT Pub. Date: Feb. 9, 2017

(65) Prior Publication Data

US 2018/0213607 A1 Jul. 26, 2018

(30) Foreign Application Priority Data

Jul. 31, 2015 (DE) ..... 102015214627.8

(51) Int. Cl.
*H05B 3/26* (2006.01)
*H05B 3/22* (2006.01)

(52) U.S. Cl.
CPC ..... *H05B 3/262* (2013.01); *H05B 3/22* (2013.01); *H05B 2203/013* (2013.01); *H05B 2203/017* (2013.01)

(58) Field of Classification Search
CPC ..... B60S 1/026; B60S 1/60; H05B 2203/013; H05B 2203/017; H05B 3/22; H05B 3/262; H05B 2203/011; H05B 3/84
(Continued)

(56) References Cited

U.S. PATENT DOCUMENTS 3,440,720 A * 4/1969 Sprague ..... H05B 3/16 427/124
4,952,903 A * 8/1990 Shibata ..... G01N 27/4067 204/426

(Continued)

FOREIGN PATENT DOCUMENTS

DE 202010007081 U1 8/2010
DE 102012204235 A1 9/2013

(Continued)

OTHER PUBLICATIONS

Espacenet Machine Translation of the description of WO 2013/092964 A2.*

(Continued)

*Primary Examiner* — Charles P. Cheyney
(74) *Attorney, Agent, or Firm* — Michael E. Tschupp; Andre Pallapies; Brandon G. Braun

(57) ABSTRACT

A heating device for a domestic appliance includes a planar carrier having a carrier surface. Thermally sprayed onto the carrier surface is a layer structure, and a first solder volume is applied to the layer structure. The solder volume is an ultrasonically soldered-on solder volume. The layer structure can hereby be a heating conductor layer.

17 Claims, 3 Drawing Sheets

(58) Field of Classification Search
USPC ..... 219/203, 538, 202, 216
See application file for complete search history.

(56) References Cited

U.S. PATENT DOCUMENTS

| | | | | |
|---|---|---|---|---|
| 5,299,726 | A * | 4/1994 | Sauer | B23K 1/06 228/111.5 |
| 5,355,144 | A * | 10/1994 | Walton | B32B 17/10036 343/713 |
| 5,510,594 | A * | 4/1996 | Mori | H01C 17/02 219/121.69 |
| 5,670,966 | A * | 9/1997 | Dishart | B32B 17/10036 343/713 |
| 5,889,261 | A * | 3/1999 | Boardman | H05B 3/82 219/543 |
| 6,037,572 | A * | 3/2000 | Coates | H05B 1/0263 219/465.1 |
| 6,762,396 | B2 * | 7/2004 | Abbott | F27D 11/02 118/724 |
| 9,493,906 | B2 * | 11/2016 | Werkman | D06F 75/24 |
| 9,496,632 | B2 * | 11/2016 | Schmalbuch | B23K 1/002 |
| 9,509,088 | B2 * | 11/2016 | Timmermann | B32B 37/16 |
| 9,994,195 | B2 * | 6/2018 | Lesmeister | H05B 3/84 |
| 10,118,364 | B2 * | 11/2018 | Massault | B60J 1/02 |
| 2002/0096512 | A1 * | 7/2002 | Abbott | C23C 4/123 219/543 |
| 2004/0112892 | A1 * | 6/2004 | Abbott | H05B 3/68 219/538 |
| 2004/0134899 | A1 * | 7/2004 | Hiramatsu | H01L 23/49894 219/544 |
| 2006/0278631 | A1 * | 12/2006 | Lee | H05B 3/342 219/529 |
| 2007/0138165 | A1 * | 6/2007 | Russegger | B29C 45/2737 219/541 |
| 2008/0217324 | A1 * | 9/2008 | Abbott | C23C 24/04 219/538 |
| 2011/0147357 | A1 | 6/2011 | Bokelmann et al. | |
| 2011/0297660 | A1 * | 12/2011 | Fritz | B60R 1/0602 219/202 |
| 2012/0111851 | A1 * | 5/2012 | Hyllberg | B29C 48/83 29/592.1 |
| 2012/0247641 | A1 * | 10/2012 | Ruggiero | H05B 3/26 156/60 |
| 2014/0332518 | A1 | 11/2014 | Lesmeister et al. | |
| 2015/0053664 | A1 * | 2/2015 | Hu | H05B 3/16 219/213 |
| 2016/0219650 | A1 * | 7/2016 | Matsunami | G01N 21/3504 |
| 2017/0274464 | A1 * | 9/2017 | Reul | B32B 17/061 |
| 2017/0278631 | A1 * | 9/2017 | Choi | H01G 4/232 |
| 2017/0325290 | A1 * | 11/2017 | Kabelitz | H01B 13/0016 |
| 2018/0242401 | A1 * | 8/2018 | Kobler | H05B 3/22 |

FOREIGN PATENT DOCUMENTS

| | | | | |
|---|---|---|---|---|
| DE | 102013201386 | A1 | 7/2014 | |
| EP | 0963143 | A1 | 12/1999 | |
| WO | 2013092964 | A2 | 6/2013 | |
| WO | WO-2013092964 | A2 * | 6/2013 | H05B 3/24 |

OTHER PUBLICATIONS

International Search Report PCT/EP2016/065541 dated Sep. 23, 2016.

National Search Report CN 201680044726.2 dated Mar. 24, 2020.

* cited by examiner

CONNECTING THERMALLY-SPRAYED LAYER STRUCTURES OF HEATING DEVICES

CROSS-REFERENCES TO RELATED APPLICATIONS

This application is the U.S. National Stage of International Application No. PCT/EP2016/065541, filed Jul. 1, 2016, which designated the United States and has been published as International Publication No. WO 2017/021076 A1 and which claims the priority of German Patent Application, Serial No. 10 2015 214 627.8, filed Jul. 31, 2014, pursuant to 35 U.S.C. 119(a)-(d).

BACKGROUND OF THE INVENTION

The invention relates to a heating device for a domestic appliance, comprising a planar carrier with a carrier surface, at least one layer structure that is thermally sprayed onto the carrier surface and at least one solder volume that is applied to at least one thermally sprayed-on layer structure. The invention also relates to a domestic appliance with such a heating device. The invention further relates to a method for producing a heating device for a domestic appliance, wherein a planar carrier with at least one thermally sprayed-on layer structure applied thereon is provided. The invention is, in particular, advantageously usable in cooking devices, in particular with steam cooking capabilities, in washing machines, dishwashers, laundry care appliances and small domestic appliances.

In the conventional soldering (e.g. laser soldering, reflow soldering, hand soldering, etc.) of thermally-sprayed layers, the connecting or soldering site is treated with flux to enable adhesion of solder or solder mass. Typically, the thermally-sprayed layer has a thin oxide layer or "oxide skin" which makes an adhesion of the solder mass more difficult or even effectively impossible. The flux serves to break up the oxide skin chemically. However, the flux disadvantageously penetrates into the thermally-sprayed layer, since this is typically slightly porous. It can even penetrate further to porous layers lying thereunder (for example, an insulating layer) and impair their function. In order to prevent a negative influence of the flux (e.g. a worsening of an electrical insulating property), it must previously be washed out thoroughly with solvent.

It is already known to produce conducting areas or connecting areas on thermally-sprayed heating conductor layers by means of thermally-sprayed metals (e.g. copper, tin, bronze) and then to solder these metals by means of conventional soldering methods. For the application of not full-surface connecting areas of thermally-sprayed metals (e.g. connecting areas, pads, etc.), however, complex masking must be used. Wear of such masks is high. An application efficiency is low.

DE 10 2012 204 235 A1 discloses a domestic appliance for the preparation of foods having a first component and a second component connected to the first component, wherein at least at a connecting site of both components, the first component is made of a first material and the second component is made of a second material different from the first material, and at the connecting site for connecting the components, a solder connection is formed, wherein the solder connection is an ultrasonic solder connection. DE 10 2012 204 235 A1 also concerns a method for producing a domestic appliance.

EP 0 963 143 A1 discloses a ceramic carrier with an electric circuit and a connecting device which has at least one metallic connection, for example in the form of a threaded bolt. The connection or the connecting device are connected to the carrier with compensating means consisting of a metal with a greater deformability than the material of the connection, preferably by means of active soldering. The compensating means can be configured in the form of an annular disk or the like and can consist of copper and compensates for the tensions during cooling. The active solder advantageously has a base of silver and copper and a reactive alloy component, for example, titanium or a rare-earth metal. The connecting device can represent both a highly loadable mechanical fastening connection for the carrier and also an electrical connection for the circuit.

DE 20 2010 007 081 U1 discloses a device for generating a gas-tight ultrasonic solder connection of two different materials as bonding partners A and B at low temperatures wherein these have a corresponding binding capability with the solder material used, having the following features: a positioning and pre-heating device for a bonding partner B lying lowermost on the joining apparatus, a positioning and placement device for the bonding partner A to be placed thereon, a heating and soldering device for joint warming and soldering of the bonding partners A and B, and a removal device for the joined bonding partners A and B.

DE 10 2013 201 386 A1 discloses a cooking hob with a hob plate on which at least one cooking site is formed, and an operating device which comprises electronic components which are positioned, in a plan view of the hob plate, beside the cooking site, and a pot recognition device with which the position of a preparation vessel on the hob plate is recognizable, wherein the pot recognition device has at least one electrically conductive sensor which is configured as a conductor line on the hob plate and, for positional pot recognition, is configured for electrical interaction with a preparation vessel and at least in portions is arranged as an areal delimitation for an area on the hob plate within which the electronic components are arranged.

BRIEF SUMMARY OF THE INVENTION

It is an object of the present invention to overcome at least partially the disadvantages of the prior art and, in particular, to provide an improved capability for the electrical connection of thermally sprayed-on layers or layer structures of a domestic appliance.

This object is achieved with the features of the independent claims. Preferred embodiments of the invention are described, in particular, in the dependent claims.

The object is achieved with a heating device for a domestic appliance, comprising a planar carrier with a carrier surface, at least one thermally sprayed-on layer structure on the carrier surface and at least one solder volume that is applied to at least one thermally sprayed-on layer structure, wherein the at least one solder volume is an ultrasonically soldered-on solder volume.

This heating device has the advantage that the solder or the solder mass of the solder volume firmly adheres to a thermally sprayed-on layer structure without further auxiliary agents, and with a low electrical contact resistance. This is due to the fact that through the introduction of ultrasonic energy, the oxide skin of the thermally sprayed-on layer structure is broken up. By this means, the connection of the solder to the non-oxidized material of the thermally-sprayed layer lying thereunder is enabled, specifically in particular without the use of material without organic components, in particular without flux.

The solder or the solder mass advantageously has a high electrical conductivity. In particular, an electrical resistance and a current load capacity of an electrical conductor or solder connection formed by the solder is dimensioned so that a suitability goes beyond a protection low voltage, specifically in particular into a power region (e.g. of 230 V, up to more than 8 A). Particularly advantageously, the solder connection is also sufficiently dimensioned for a use in the high voltage region (e.g. from about 1250 V AC or 1800 V AC).

With the ultrasonic support, in general a soldering on of solder is possible on surfaces that are not wettable with solder using classic soldering methods. It is in general possible also to wet very severely oxidized surfaces or non-metallic (e.g. glassy or ceramic) surfaces strongly and precisely with solder. Thus, with ultrasonic soldering, for example, an exposed ceramic insulation (e.g. a ceramic insulating layer) can easily be contacted mechanically and electrically with solder mass.

Additionally, ultrasonic soldering is easily usable since it does not need to be masked. Furthermore, in comparison with thermal spraying of metallic connecting layers, etc., it is markedly more efficient in the use of material (material usage for generating the solder or bond site). Additionally, a saving of cycle time and costs can be achieved.

Good adhesion strength is also achieved if the thermally sprayed-on layer structure is porous. Good adhesion strength is also maintained under temperature variation loading.

Further achieved is the advantage that no corrosion occurs in the connecting site as with "classic" soldering.

Moreover, the ultrasonic solder connection is configurable temperature-stable to at least 150° C. It can also have a thermal coefficient of expansion adapted to the substrate and/or the thermally sprayed-on layer. It is also ageing-resistant at high continuous operation temperatures over the whole product lifespan.

A planar carrier can be understood, for example, as a flat carrier or a curved carrier (e.g. in tubular form). The carrier can have, in particular, a panel-like basic form.

A further development is that the carrier surface is an electrically insulating carrier surface. The electrically insulating carrier surface can be an electrically insulating layer (e.g. of ceramics) applied to a main body or a substrate of the carrier (e.g. a metal sheet). This layer can also have been thermally sprayed-on. The electrically insulating carrier surface can, however, also be a surface-treated (e.g. oxidized) layer region of a main body of the carrier. The electrically insulating carrier surface can have, in particular, a non-negligible porosity. On use of solder flux, this can penetrate, if applicable, into the relevant pores and, if applicable, reduce or even effectively cancel a capacity for electrical insulation—particularly if a high voltage is applied. In particular, if the main body is already itself electrically insulating and temperature-resistant (up to at least 150° C.), a specially formed surface layer can be dispensed with and the carrier surface then represents the non-modified surface of the main body. This can be the case, for example, if the main body consists of ceramics.

The carrier surface can be configured at least on a flat side on which a thermally sprayed-on layer or layer structure is situated, electrically insulating over the whole area. Alternatively, the carrier surface is configured electrically insulating only beneath electrically insulating layers or layer structures, if applicable, laterally protruding beyond the layers or layer structures. Thus, electrically conductive thermally-sprayed layer structures can be thermally sprayed-on onto equally wide or somewhat wider layer structures of an electrically insulating layer.

A thermally sprayed-on layer can be understood to be a layer which, for example, has been produced by means of molten bath spraying, electric arc spraying, plasma spraying (e.g. atmospheric, under protective gas or under reduced pressure), flame spraying (e.g. powder flame spraying, wire flame spraying or plastic flame spraying), high velocity flame spraying, detonation spraying, cold gas spraying, laser spraying or PTWA spraying, in particular onto the carrier surface. If a plurality of thermally sprayed-on layers or layer structures are present, at least two thereof can be identically configured, e.g. with regard to their material, their layer thickness, etc. Also, at least two thermally sprayed-on layer structures can be configured differently, e.g. with regard to their material, their layer thickness, etc.

At least one thermally sprayed-on layer or layer structure can be, for example, a metallic layer or layer structure, e.g. comprising aluminum (Al), bronze, copper (Cu), silver (Ag), tin (Sn), etc. or an alloy thereof. The thermally sprayed-on layer can also be a nickel-chromium alloy (NiCr). The thermally sprayed-on layer can also be a ceramic layer, for example, an electrically insulating layer. A surface of the thermally sprayed-on layer or layer structure can be oxidized.

A layer structure should be understood, in particular, to be a layer which, in plan view, has a form different from the form of the carrier surface, that is, no layer covering the whole carrier surface. Rather, the layer structure on the carrier or the carrier surface has, in plan view, its own contour ("outer contour") which extends at least partially on the carrier surface (and not only on its edge). The layer structure can be present, in particular, in the form of at least one elongate conducting track or line. The conducting line can be wholly or partially straight and/or wholly or partially curved. For example, the conducting line can have a meandering course. The conducting line can however be present, for example, in the form of a short stripe or a rectangular, round, oval etc. contact field.

An ultrasonically soldered-on solder volume is, in particular, a solder volume that has been applied by means of an ultrasonic soldering method.

It is one embodiment that at least one thermally sprayed-on layer structure is a resistance heating conductor layer, in particular, a thick film. The heating conductor layer can be, in particular, an elongate heating conductor line. The heating conductor line can extend, for example, in a meandering or spiral form. Solder mass can be applied, in particular, in the region of at least one end of the heating conductor layer—in particular, heating conductor line—in order to connect it electrically. As the material of the heating conductor layer, in particular, aluminum, an aluminum compound or a nickel-chromium compound can be provided. The heating conductor layer can thus, in particular, represent a thermally sprayed-on area heater for domestic appliances.

It is a further embodiment that at least one ultrasonically soldered-on solder volume electrically connects the thermally sprayed-on layer structure to at least one other component of the heating device. By this means, electrical connections can be created with the thermally sprayed-on layer structure particularly rapidly, economically and reliably.

It is a further development that at least one ultrasonically soldered-on solder volume is a solder volume produced in one step or a single stage, which enables a particularly simple and rapid electrical connection. The solder volume can be applied, for example, in one process by means of an ultrasonic soldering iron between the thermally sprayed-on layer structure and another component.

It is a further embodiment that at least one ultrasonically soldered-on solder volume is electrically connected by means of a further solder volume not applied by ultrasound, to at least one other component of the heating device. This has the advantage that a part of a solder connection can also be produced by means of another soldering method (e.g. laser soldering, reflow soldering, hand soldering, etc.), which enables a particularly varied possibility for applying the solder volume. In this way, another soldering method can bring about soldering for particular surfaces more gently and/or for complex geometries, simply and more rapidly. With this embodiment, in a further development, a solder volume can firstly be ultrasonically soldered onto a thermally sprayed-on layer and then the ultrasonically soldered-on solder volume can be electrically further connected by means of a solder volume applied by other means. The ultrasonically soldered-on solder volume therefore serves as the basis or substrate for the solder volume not applied with ultrasound. The application of solder volumes by different soldering methods is executable, particularly in the context of a multi-stage, e.g. two-stage, method.

It is a further embodiment that at least one other component of the heating device is a further thermally sprayed-on layer structure, on which at least one ultrasonically soldered-on solder volume is present. Then, for example, in a first stage, both thermally sprayed-on layer structures (in general: bonding partners) can be provided with an ultrasonically soldered-on solder volume and subsequently, in a second stage, the two ultrasonically soldered-on solder volumes are connected to one another by means of another soldering method.

For example, in this way, a layer structure produced with arc spraying can be connected to a layer structure produced through atmospheric plasma spraying, which are separated from one another by a laser cut.

In this way, for example, thermally sprayed-on conductor lines extending mutually parallel can be connected to one another across gaps (e.g. laser cuts). This can be used, for example, for subsequent equalization of an electrical resistor of a thermally sprayed-on heating conductor in order to ensure a required nominal power output of the heating device ("trimming") and/or for repairing faulty sites in thermally sprayed-on conductor lines (e.g. heating conductor lines).

It is an alternative development that the solder volume in the second stage also is or has been ultrasound soldered-on. This corresponds to a two-stage ultrasonic soldering of at least one thermally sprayed-on layer structure.

It is a further embodiment that at least one other component of the heating device is a metallic contact. Then, for example, in a first stage, the thermally sprayed-on layer structure can be provided with an ultrasonically soldered-on solder volume and subsequently, in a second stage, the ultrasonically soldered-on solder volume can be directly connected to the metallic contact by means of another soldering method.

The metallic contact can be, for example, a contact field applied by galvanizing, application of a metal film, etc. to the carrier surface, e.g. a contact element, for example, of copper.

It is moreover a further embodiment that the metallic contact is a contact element of an electrical or electronic component, for example, a contact pin of a plug connector part (e.g. connector plug) or an electrical connector of an electrical or electronic component (e.g. a contact region of an SMD component such as an NTC resistor, a blow-out fuse, of a sensor—e.g. cast in solder glass, etc.). By this means, a thermally-sprayed layer can be connected particularly easily and lastingly to a circuit, etc. The electrical or electronic component is advantageously an SMD ("Surface Mounted Device"). Thus, thermally sprayed-on layer structures and electrical and/or electronic components can be connected to one another particularly easily and economically. The SMD component (e.g. of the size 0603, 0805 or 1206) can be placed by means of a vacuum gripper. Wired components which are provided for a through hole technology (THT) mounting can also be connected by means of their metallic contact to the thermally sprayed-on structure.

It is a further embodiment that at least one ultrasonically soldered-on solder volume covers at least a portion of the thermally sprayed-on layer structure—in particular a heating conductor layer—without connecting said layer structure electrically to another—in particular electrically conductive—component of the heating device. In this embodiment, in particular, at least one solder layer (also designated a "conductor layer") can be applied to the heating conductor layer in order to reduce an electric power density in the heating conductor layer locally. Thereby also, local heating ("hot spots") can be prevented. A conductor layer can be applied, for example, to power connections at design-related constrictions in conductor lines, at corners and/or at reversal points in the heating conductor layout. The conductor layer or the solder material can also lie on the carrier surface.

The object is also achieved with a domestic appliance having at least one heating device as described above. The domestic appliance provides the same advantages as the heating device and can be constructed similarly.

The domestic appliance can be, for example, a cooking device or an accessory for a cooking device (e.g. a heatable cooking chamber partition). The cooking device can have, for example, a steam cooking function, the heating device being associated with a steam generating apparatus in order to evaporate water present in the steam generating apparatus. The cooking device can be, for example, an oven with a steam cooking capability or a dedicated steam cooker. The heating device can then represent, for example, a bottom of a water tank.

In the case of the heatable cooking chamber partition, at least one thermally sprayed-on layer structure can be present on one side or on both sides, in particular at least one heating conductor layer (structure).

The domestic appliance can also be a laundry care appliance. The heating device can then be used, for example, as a washing solution heater of a washing machine or a laundry dryer. The heating device can also be provided as a process air heater.

The domestic appliance can further be a dishwasher. The heating device can then be used, for example, as a heater for heating the washing liquid. In this case, the heater is, in particular, a component of a heating pump assembly.

The domestic appliance can also be an electrically operated small domestic appliance, e.g. a water boiler, a coffee machine (e.g. in the form of an espresso machine), a toaster, etc.

The heating device can be configured as a tube (in general: a rotationally symmetrical body), wherein at least one thermally sprayed-on sealant layer heating conductor is present on a wall of the tube of the domestic appliance. The tube can then be used or intended, in particular, as a flow-through heater for gas passed therethrough (e.g. process air) and/or liquid (e.g. water to be evaporated, washing fluid or washing solution).

The object is further achieved with a method for producing a heating device for a domestic appliance, a planar (flat and/or curved) carrier being provided with at least one thermally sprayed-on layer structure applied thereto and at least one solder volume is ultrasonically soldered onto at least one thermally sprayed-on layer structure. The method provides the same advantages as the heating device and the domestic appliance and can be constructed similarly thereto and vice versa.

It is therefore one embodiment that at least one thermally sprayed-on layer structure is ultrasonically soldered in one stage to another component of the heating device. For this purpose—for example, by means of an ultrasonic soldering iron—in one process, a track of solder can be drawn from the at least one thermally sprayed-on layer structure to the other component.

It is another embodiment that at least one thermally sprayed-on layer structure is ultrasonically soldered in two stages to another component of the heating device in that in a first stage, a solder volume is applied at least to at least one thermally sprayed-on layer structure by means of ultrasonic soldering and this solder volume is soldered in a second stage to the other component of the heating device. The soldering in the second stage can be carried out with or without ultrasound.

It is a further embodiment that the other component of the heating device is a thermally sprayed-on layer structure, onto which, in the first stage, a solder volume is applied by ultrasonic soldering and this ultrasonically applied solder volume is soldered, in the second stage, to another ultrasonically applied solder volume of the heating device.

Furthermore, it is an embodiment that the ultrasonic soldering is carried out by means of an ultrasonic soldering iron. The ultrasonic soldering iron can have, for example, a sonotrode, which is configured as a soldering tip.

It is another embodiment that the ultrasonic soldering is carried out by means of an ultrasonic solder bath (or soldering bath). Herein, a component to be wetted with solder can be dipped in a solder bath before or after mounting on the carrier. The wetting of this component therefore does not need to be undertaken on the carrier, which enables simplified production. The respective individual steps can be improved, where appropriate, by a process of heat treatment (e.g. by pre-heating) of the component.

BRIEF DESCRIPTION OF THE DRAWINGS

The above-described properties, features and advantages of this invention and the manner in which this is achieved will now be described more clearly and intelligibly with an exemplary embodiment, illustrated in the following schematic description of an exemplary embodiment, which will be described in detail making reference to the drawings.

DETAILED DESCRIPTION OF EXEMPLARY EMBODIMENTS OF THE PRESENT INVENTION

Figure 1:
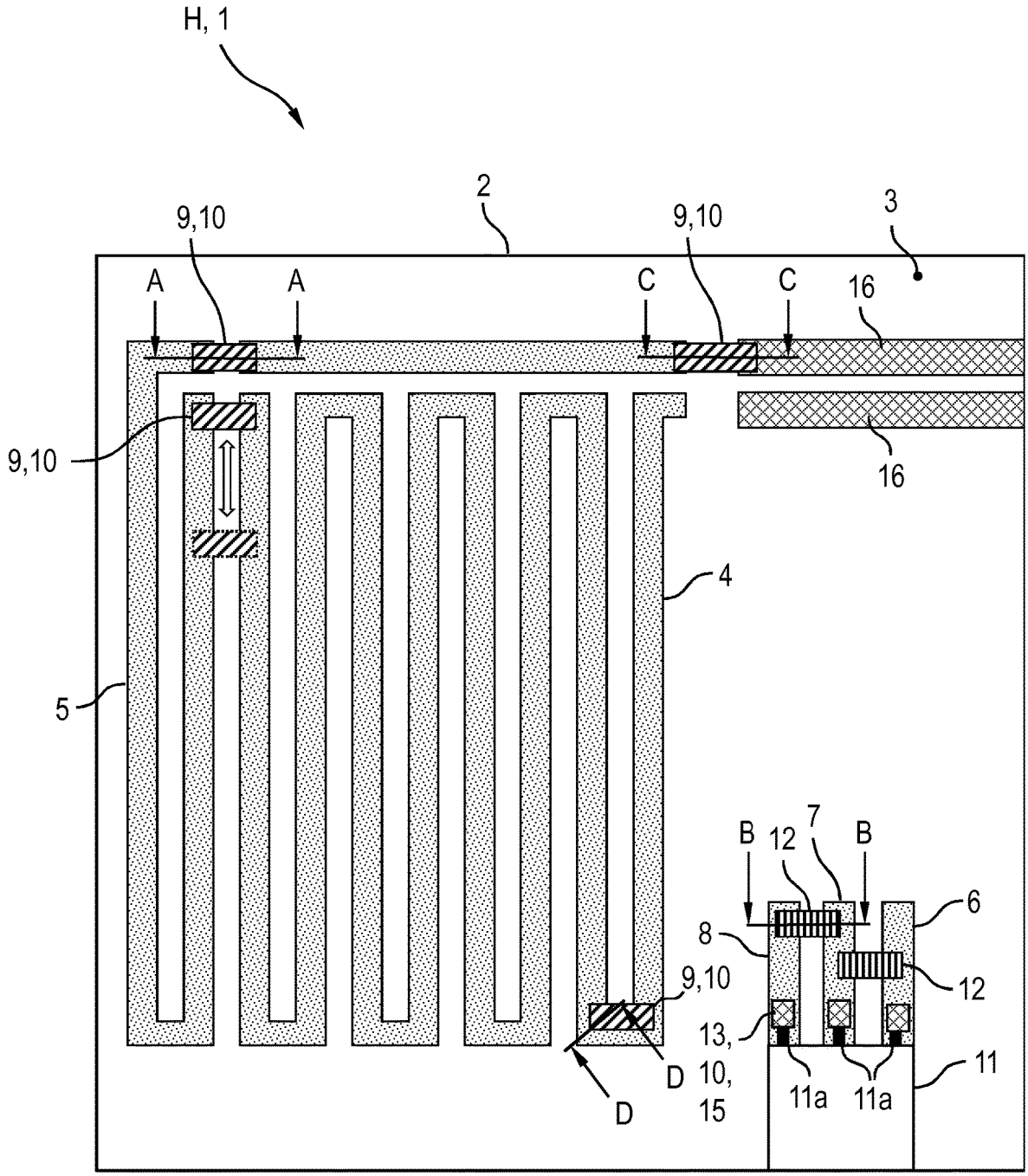
FIG. 1 is a plan view sketch of a heating device of a domestic appliance.

FIG. 1 shows a plan view of a heating device 1 of a domestic appliance H. The heating device 1 can be used, for example, for heating water situated in a water tank of a steam generator. The domestic appliance H can, however, also be an oven with a steam cooking capability, a dedicated steam cooker, an electrically heatable cooking chamber partition, a laundry care appliance, a dishwasher, a small domestic appliance, etc.

The heating device 1 has a planar carrier 2 (e.g. made of a metal sheet) with an electrically insulating carrier surface 3 (e.g. made of a light porous, for example thermally sprayed-on, ceramic layer). A plurality of metallic layer structures 4 to 8 are thermally sprayed onto the carrier surface 3. The thermally sprayed-on layer structures 4 to 8 are electrically insulated from one another by the carrier surface 3 and comprise: a first (long) meandering heating conductor line 4, a second (short) meandering heating conductor line 5 and three short straight conductor lines 6 to 8.

The two heating conductor lines 4 and 5 are electrically connected to one another by two tracks 9 made of a first solder or solder material 10. By this means, the two heating conductor lines 4 and 5 are electrically connected in series. If the second heating conductor line 5 is not to be used, in place of the two tracks 9, the two corresponding ends of the first heating conductor line 4 could be directly connected to one another by means of a track made of the first solder material 10 (not shown). The electrical resistance can also be exactly trimmed in that a position of the lower track 9 here between the heating conductor lines 4 and 5 can be varied, as indicated by the double arrow. By means of a suitable placement of the tracks 9, the common heating conductor line 4, 5 can consequently be trimmed.

Figure 2:
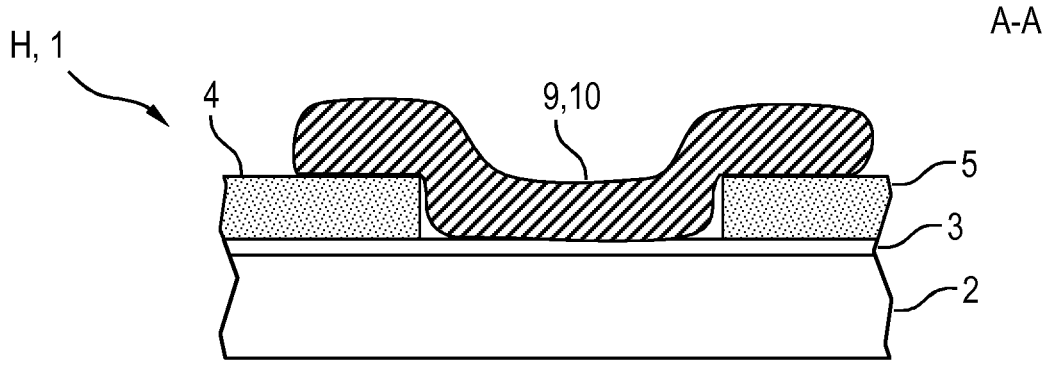
FIG. 2 is a sectional representation in side view of a first portion of the heating device of FIG. 1.

As shown in FIG. 2 in section A-A, for this purpose, the track 9 of the first solder material 10 has been ultrasonically soldered on in one stage from the surface of the first heating conductor line 4 across the carrier surface 3 to the surface of the second heating conductor line 5. Herein, due to the ultrasonic energy introduced, the first solder material 10 holds both on the heating conductor lines 4 and 5 as well as on the carrier surface 3 without flux being needed for this. The track 9 can be applied, for example, by means of a soldering with an ultrasonic soldering iron.

Referring again to FIG. 1, the three straight thermally sprayed-on conductor lines 6 to 8 are connected to a connector plug 11 of the heating device 1, in particular to respective electrical contacts 11*a* of the connector plug 11. Adjacent conductor lines 6 and 7 or 7 and 8 are connected via respective SMD components 12. The SMD components 12 are herein, by way of example, NTC resistors which have electrical contacts or contact fields 14 at their end regions in the form of solder terminals. Thus, via the plug frame 11, measurement values (e.g. electrical resistance values, voltage values or current values) associated with a respective temperature can be read off.

Figure 3:
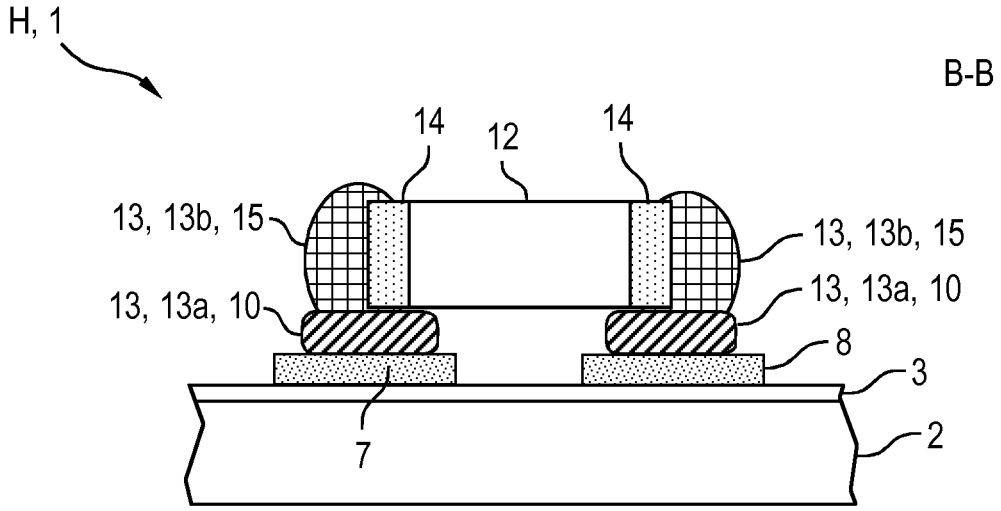
FIG. 3 is a sectional representation in side view of a second portion of the heating device of FIG. 1.

The SMD components 12 are fastened via soldering points 13 from the first solder material 10 and a second solder material 15 to the conductor lines 6 and 7 or 7 and 8, as shown in FIG. 3 as a section B-B of the heating device 1. Herein, the conductor lines 6 and 7 or 7 and 8 have been ultrasonically soldered with a solder volume of the first soldier material 10. Consequently, the SMD components 12 have been placed with their contact fields 14 on respective solder volumes of the solder material 10. Then, the solder volumes of the solder material 10 have been soldered to the associated contact fields 14 by means of a non-ultrasonic soldering method (e.g. a laser soldering, reflow soldering, hand soldering, etc.) using the second solder material 15. The first solder material 10 and the second solder material 15 can be the same or different.

Consequently, the two conductor lines 7 and 8 are electrically connected to one another by means of the SMD component 12 via the soldering points 13, which have (partial) solder volumes 13*a* and 13*b* of the first solder material 10 and/or the second solder material 15.

Similarly, for example, the electrical contacts 11*a* (e.g. contact posts or contact pins) of the connector plug 11 are mounted on the conductor lines 6 to 8, wherein they can have been dipped in a solder bath (not shown) before the mounting of the connector plug 11. The solder bath can function with or without an ultrasonic input. The solder material introduced in the solder bath can be, for example, one of the solder materials 10 or 15.

Figure 4:
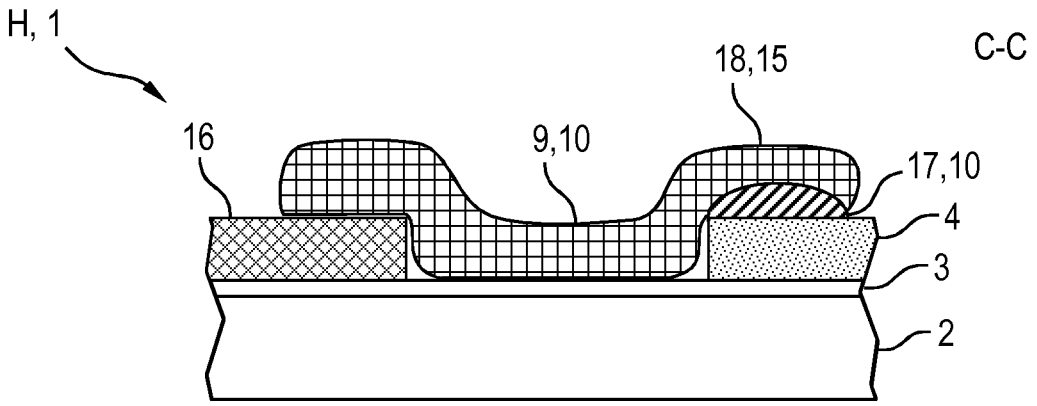
FIG. 4 is a sectional representation in side view of a third portion of the heating device of FIG. 1.

Referring again to FIG. 1, in addition, two metallic contact areas 16 are applied to the carrier surface, by means of which the combined heating conductor line 4 and 5 can be electrically connected at the end, for example, to a voltage supply. In this regard, FIG. 4 shows a sectional representation in a side view of a section C-C of the heating device 1.

In this regard, similarly to FIG. 3, a solder volume (solder point) 17 of the first solder material 10 has been ultrasonically soldered onto the thermally sprayed-on heating conductor line 4, and then a track 18 of the second solder material 15 has been drawn with another soldering method (not involving ultrasound) from the solder volume 17 to the metallic contact area 16, or vice versa.

Similarly, the two thermally-sprayed heating conductor lines 4 and 5 could also each be provided with ultrasonically soldered-on solder volumes 17 of the first solder material 10, which are connected to one another via a track 18 of the second solder material 15.

Figure 5:
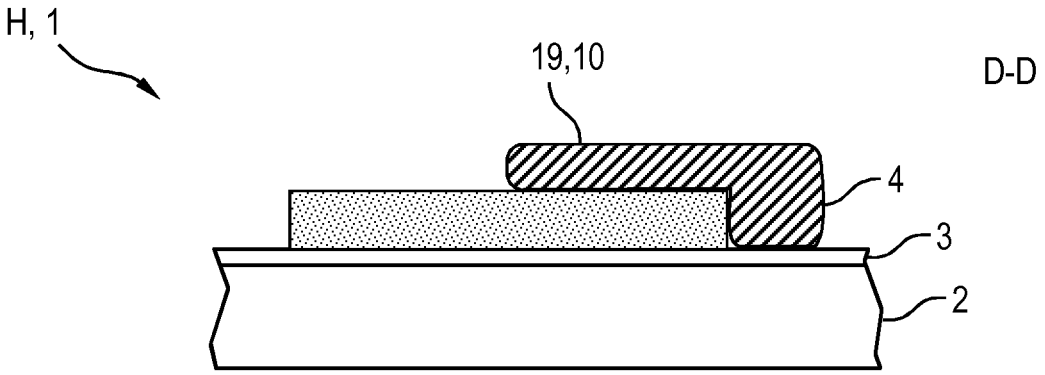
FIG. 5 is a sectional representation in side view of a fourth portion of the heating device of FIG. 1.

Referring once more to FIG. 1, at a bend in the heating conductor line 4, a conducting layer 19 has also been ultrasonically soldered only onto the heating conductor line 4 and, if appropriate, the carrier surface 3, in order to reduce a current density there and so to prevent a formation of "hot spots", as shown in the section D-D in FIG. 5.

Naturally, the present invention is not restricted to the exemplary embodiment disclosed.

In general, "a", "an", etc. can be understood as singular or plural, in particular in the sense of "at least one" or "one or more", etc., provided this is not explicitly excluded, e.g. by the expression "exactly one", etc.

A numerical value can also include the given value as a typical tolerance range, provided this is not explicitly excluded.

The invention claimed is:

1. A heating device for a domestic appliance, comprising:
- a planar carrier having an insulating carrier surface,
- a first metallic layer structure thermally sprayed directly onto the insulating carrier surface,
- a second metallic layer structure thermally sprayed directly onto the insulating carrier surface, and
- a first volume of solder ultrasonically melted onto the first metallic layer structure, the second metallic layer structure, and the insulating carrier surface.

2. The heating device of claim 1, wherein the first layer structure is a heating conductor layer.

3. The heating device of claim 1, wherein the first volume of solder electrically connects the first layer structure to another component of the heating device.

4. The heating device of claim 1, further comprising a second volume of solder which is not applied by ultrasound and electrically connects the first volume of solder to another component of the heating device.

5. The heating device of claim 3, wherein the other component is a metallic contact.

6. The heating device of claim 5, wherein the metallic contact is a contact of an electrical or electronic component.

7. The heating device of claim 1, wherein a second volume of solder covers at least a portion of the first layer structure without connecting the first layer structure electrically to another electrically conductive component of the heating device.

8. A domestic appliance, comprising:
- a heating device, said heating device comprising a planar carrier having an insulating carrier surface,
- a first metallic layer structure thermally sprayed directly onto the insulating carrier surface, and
- a first volume of solder ultrasonically melted onto both the metallic layer structure and the insulating carrier surface, wherein the first volume of solder electrically connects the first layer structure to another component of the heating device, the other component is a second metallic layer structure thermally sprayed onto the carrier surface; and the first volume of solder is applied to the second metallic layer structure.

9. The domestic appliance of claim 8, wherein the first layer structure is a heating conductor layer.

10. The domestic appliance of claim 8, further comprising a second volume of solder which is not applied by ultrasound and electrically connects the first volume of solder to another component of the heating device.

11. The domestic appliance of claim 8, wherein the other component is a metallic contact.

12. The domestic appliance of claim 11, wherein the metallic contact is a contact of an electrical or electronic component.

13. The domestic appliance of claim 8, wherein the first volume of solder covers at least a portion of the layer structure without connecting the layer structure electrically to another electrically conductive component of the heating device.

14. A method for producing a heating device for a domestic appliance, said method comprising:
- thermally spraying a first metallic layer structure directly onto a planar carrier having an insulating carrier surface,
- ultrasonically soldering a first volume of solder onto both the metallic layer structure and the insulating carrier surface, wherein ultrasonically soldering includes melting the volume of solder, and
- ultrasonically soldering the first layer structure in two stages to another component of the heating device, with a first one of the two stages representing the ultrasonic soldering of the first volume of solder onto the layer structure, and with a second one of the two stages including soldering the first volume of solder to the other component of the heating device,
- wherein the other component of the heating device is a second layer structure that is thermally sprayed onto the planar carrier; and wherein in the second of the two stages the first volume of solder is soldered to a second ultrasonically applied volume of solder of the heating device.

15. The method of claim 14, further comprising ultrasonically soldering the layer structure in one stage to another component of the heating device.

16. The method of claim 14, wherein the ultrasonic soldering is carried out by using an ultrasonic soldering iron.

17. The method of claim 14, wherein the ultrasonic soldering is carried out by using an ultrasonic solder bath.

* * * * *